US005500108A

United States Patent [19]

Durand et al.

[11] Patent Number: 5,500,108

[45] **Date of Patent: *Mar. 19, 1996**

[54] GASOLINE UPGRADING PROCESS

[75] Inventors: Paul P. Durand, Wilmington, Del.; Hye K. C. Timken, Woodbury, N.J.

[73] Assignee: Mobil Oil Corporation, Fairfax, Va.

[ * ] Notice: The term of this patent shall not extend beyond the expiration date of Pat. No. 5,411,658.

[21] Appl. No.: 303,908

[22] Filed: Sep. 9, 1994

Related U.S. Application Data

[63] Continuation-in-part of Ser. No. 133,403, Oct. 8, 1993, Pat. No. 5,411,658, which is a continuation-in-part of Ser. No. 891,124, Jun. 1, 1992, Pat. No. 5,413,696, which is a continuation-in-part of Ser. No. 850,106, Mar. 12, 1992, Pat. No. 5,409,596, which is a continuation-in-part of Ser. No. 745,311, Aug. 15, 1991, Pat. No. 5,346,609.

[51] Int. Cl.[6] ..... C10G 69/02

[52] U.S. Cl. ..... 208/89; 208/212; 208/213; 208/58

[58] Field of Search ..... 208/89, 212, 213, 208/58

[56] References Cited

U.S. PATENT DOCUMENTS

| | | | |
|---|---|---|---|
| 3,957,625 | 5/1976 | Orkin | 208/211 |
| 4,211,640 | 7/1980 | Garwood et al. | 208/255 |
| 4,753,720 | 6/1988 | Morrison | 208/135 |
| 4,827,076 | 5/1989 | Kokayeff et al. | 208/212 |
| 4,950,387 | 8/1990 | Harandi et al. | 208/49 |

*Primary Examiner*—Helane Myers

*Attorney, Agent, or Firm*—A. J. McKillop; M. D. Keen

[57] ABSTRACT

Low sulfur gasoline of relatively high octane number is produced from a cracked, sulfur-containing olefinic naphthas by hydrodesulfurization followed by treatment over an acidic catalyst comprising an intermediate pore size zeolite such as zeolite ZSM-5 in combination with molybdenum. The use of the molybdenum in combination with the zeolite has been found to give improved catalytic acitivity coupled with lower coking, longer catalyst life and other advantages.

20 Claims, 4 Drawing Sheets

GASOLINE UPGRADING PROCESS

CROSS REFERENCE TO RELATED APPLICATIONS

This application is a continuation-in-part of prior application Ser. No. 08/133,403 now U.S. Pat. No. 5,411,658, filed 8 Oct. 1993, which in turn, is a continuation-in-part of prior application Ser. No. 07/891,124, filed 1 Jun. 1992 now U.S. Pat. No. 5,413,696 which, in turn, is a continuation-in-part of prior application Ser. No. 07/850,106, filed 12 Mar. 1992 now U.S. Pat. No. 5,409,596 , which, in turn, is a continuation-in-part of prior application Ser. No. 07/745,311, filed 15 Aug. 1991 now U.S. Pat. No. 5,346,609, of which this application is also a continuation-in-part. The contents of Ser. Nos. 08/133,403; 07/891,124; 07/850,106 and 07/745,311 are incorporated in this application by reference.

FIELD OF THE INVENTION

This invention relates to a process for the upgrading of hydrocarbon streams. It more particularly refers to a process for upgrading gasoline boiling range petroleum fractions containing substantial proportions of sulfur impurities. Another advantage of the present process is that it enables the end point of catalytically cracked gasolines to be maintained within the limits which are expected for Reformulated Gasoline (RFG) under the EPA Complex Model.

BACKGROUND OF THE INVENTION

Catalytically cracked gasoline currently forms a major part of the gasoline product pool in the United States and it provides a large proportion of the sulfur in the gasoline. The sulfur impurities may require removal, usually by hydrotreating, in order to comply with product specifications or to ensure compliance with environmental regulations, both of which are expected to become more stringent in the future, possibly permitting no more than about 300 ppmw sulfur in motor gasolines; low sulfur levels result in reduced emissions of CO, $NO_x$ and hydrocarbons. In addition other environmental controls may be expected to impose increasingly stringent limits on gasoline composition. Currently, the requirements of the U.S. Clean Air Act and the physical and compositional limitations imposed by the Reformulated Gasoline (RFG) and EPA Complex Model regulations will result not only in a decrease in permissible sulfur levels but also in limitations on boiling range, typically measured by minimum Reid Vapor Presssure (RVP) and $T_{90}$ specifications. Limitations on aromatic content may also arise from the Complex Model regulations.

Naphthas and other light fractions such as heavy cracked gasoline may be hydrotreated by passing the feed over a hydrotreating catalyst at elevated temperature and somewhat elevated pressure in a hydrogen atmosphere. One suitable family of catalysts which has been widely used for this service is a combination of a Group VIII and a Group VI element, such as cobalt and molybdenum, on a substrate such as alumina. After the hydrotreating operation is complete, the product may be fractionated, or simply flashed, to release the hydrogen sulfide and collect the now sweetened gasoline.

Cracked naphtha, as it comes from the catalytic cracker and without any further treatments, such as purifying operations, has a relatively high octane number as a result of the presence of olefinic components. In some cases, this fraction may contribute as much as up to half the gasoline in the refinery pool, together with a significant contribution to product octane. Other unsaturated fractions boiling in the gasoline boiling range, which are produced in some refineries or petrochemical plants, include pyrolysis gasoline and coker naphtha. Pyrolysis gasoline is a fraction which is often produced as a by-product in the cracking of petroleum fractions to produce light unsaturates, such as ethylene and propylene. Pyrolysis gasoline has a very high octane number but is quite unstable in the absence of hydrotreating because, in addition to the desirable olefins boiling in the gasoline boiling range, it also contains a substantial proportion of diolefins, which tend to form gums after storage or standing. Coker naphtha is similar in containing significant amounts of sulfur and nitrogen as well as diolefins which make it unstable on storage.

Hydrotreating of any of the sulfur containing fractions which boil in the gasoline boiling range causes a reduction in the olefin content, and consequently a reduction in the octane number and as the degree of desulfurization increases, the octane number of the normally liquid gasoline boiling range product decreases. Some of the hydrogen may also cause some hydrocracking as well as olefin saturation, depending on the conditions of the hydrotreating operation.

Various proposals have been made for removing sulfur while retaining the more desirable olefins. The sulfur impurities tend to concentrate in the heavy fraction of the gasoline, as noted in U.S. Pat. No. 3,957,625 (Orkin) which proposes a method of removing the sulfur by hydrodesulfurization of the heavy fraction of the catalytically cracked gasoline so as to retain the octane contribution from the olefins which are found mainly in the lighter fraction. In one type of conventional, commercial operation, the heavy gasoline fraction is treated in this way. As an alternative, the selectivity for hydrodesulfurization relative to olefin saturation may be shifted by suitable catalyst selection, for example, by the use of a magnesium oxide support instead of the more conventional alumina.

U.S. Pat. No. 4,049,542 (Gibson) discloses a process in which a copper catalyst is used to desulfurize an olefinic hydrocarbon feed such as catalytically cracked light naphtha. This catalyst is stated to promote desulfurization while retaining the olefins and their contribution to product octane.

In any case, regardless of the mechanism by which it happens, the decrease in octane which takes place as a consequence of sulfur removal by hydrotreating creates a tension between the growing need to produce gasoline fuels with higher octane number and—because of current ecological considerations—the need to produce cleaner burning, less polluting fuels, especially low sulfur fuels. This inherent tension is yet more marked in the current supply situation for low sulfur, sweet crudes.

Processes for improving the octane rating of catalytically cracked gasolines have been proposed. U.S. Pat. No. 3,759,821 (Brennan) discloses a process for upgrading catalytically cracked gasoline by fractionating it into a heavier and a lighter fraction and treating the heavier fraction over a ZSM-5 catalyst, after which the treated fraction is blended back into the lighter fraction. Another process in which the cracked gasoline is fractionated prior to treatment is described in U.S. Pat. No. 4,062,762 (Howard) which discloses a process for desulfurizing naphtha by fractionating the naphtha into three fractions each of which is desulfurized by a different procedure, after which the fractions are recombined.

The octane rating of the gasoline pool may be increased by other methods, of which reforming is one of the most common. Light and full range naphthas can contribute substantial volume to the gasoline pool, but they do not generally contribute significantly to higher octane values without reforming. They may, however, be subjected to catalytically reforming so as to increase their octane numbers by converting at least a portion of the paraffins and cycloparaffins in them to aromatics. Fractions to be fed to catalytic reforming, for example, with a platinum type catalyst, need to be desulfurized before reforming because reforming catalysts are generally not sulfur tolerant; they are usually pretreated by hydrotreating to reduce their sulfur content before reforming. The octane rating of reformate may be increased further by processes such as those described in U.S. Pat. Nos. 3,767,568 and 3,729,409 (Chen) in which the reformate octane is increased by treatment of the reformate with ZSM-5.

Aromatics are generally the source of high octane number, particularly very high research octane numbers and are therefore desirable components of the gasoline pool. They have, however, been the subject of severe limitations as a gasoline component because of possible adverse effects on the ecology, particularly with reference to benzene. It has therefore become desirable, as far as is feasible, to create a gasoline pool in which the higher octanes are contributed by the olefinic and branched chain paraffinic components, rather than the aromatic components.

In our co-pending applications Ser. Nos. 07/850,106, filed 12 Mar. 1992, Ser. No. 07/745,311, filed 15 Aug. 1991 now U.S. Pat. No. 5,346,609, we have described processes for the upgrading of gasoline by sequential hydrotreating and selective cracking steps. In the first step of the process, the naphtha is desulfurized by hydrotreating and during this step some loss of octane results from the saturation of olefins. The octane loss is restored in the second step by a shape-selective cracking, preferably carried out in the presence of an intermediate pore size zeolite such as ZSM-5. The product is a low-sulfur gasoline of good octane rating. Reference is made to Ser. Nos. 07/745,311 and 07/850,106 (U.S. Pat. Nos. 5,346,609 and 5,409,596) for a detailed description of these processes. In Ser. No. 08/133,403 (U.S. Pat. No. 5,411,658), we have described a variant of the basic process which uses zeolite beta as the acidic component of the catalyst, used in combination with a metal component, especially molybdenum.

SUMMARY OF THE INVENTION

As shown in the prior applications referred to above, zeolite ZSM-5 is effective for restoring the octane loss which takes place when the initial naphtha feed is hydrotreated. When an intermediate pore size zeolite such as ZSM-5 is used in the second step of the process it may, as described in application Ser. No. 07/850,106 (U.S. Pat. No. 5,409,596), contain a metal function although it was recognized that the metal might in certain cases be undesirable in its effect on product octane. Metals such as the Group VIII metals, especially nickel, platinum and palladium are referred to as being useful. We have now found that molybdenum is extraordinarily effective when used in combination with ZSM-5 as the acidic component of the catalyst. Not only is the catalyst more active but it is less subject to coking, with corresponding benefits in reduced catalyst aging and increased cycle lengths. The proportion of mercaptans is also lower and there is little increase in hydrogen consumption. There is also an improvement in the quality of the treated gasoline product: at a constant product average octane rating (½(R+M)), the research octane number is about 1 number lower and the motor octane number about 1 number higher, indicating that the gasoline not only contains fewer olefins but is also less sensitive to driving conditions.

According to the present invention, therefore, a process for catalytically desulfurizing cracked fractions in the gasoline boiling range to acceptable levels uses an initial hydrotreating step to desulfurize the feed with some reduction in octane number, after which the desulfurized material is treated with a molybdenum-containing ZSM-5 catalyst to restore lost octane.

The process may be utilized to desulfurize catalytically and thermally cracked naphthas such as FCC naphtha as well as pyrolysis gasoline and coker naphthas, including light as well as full range naphtha fractions, while maintaining octane so as to reduce the requirement for alkylate and other high octane components in the gasoline blend.

DETAILED DESCRIPTION

Feed

Figure 1:
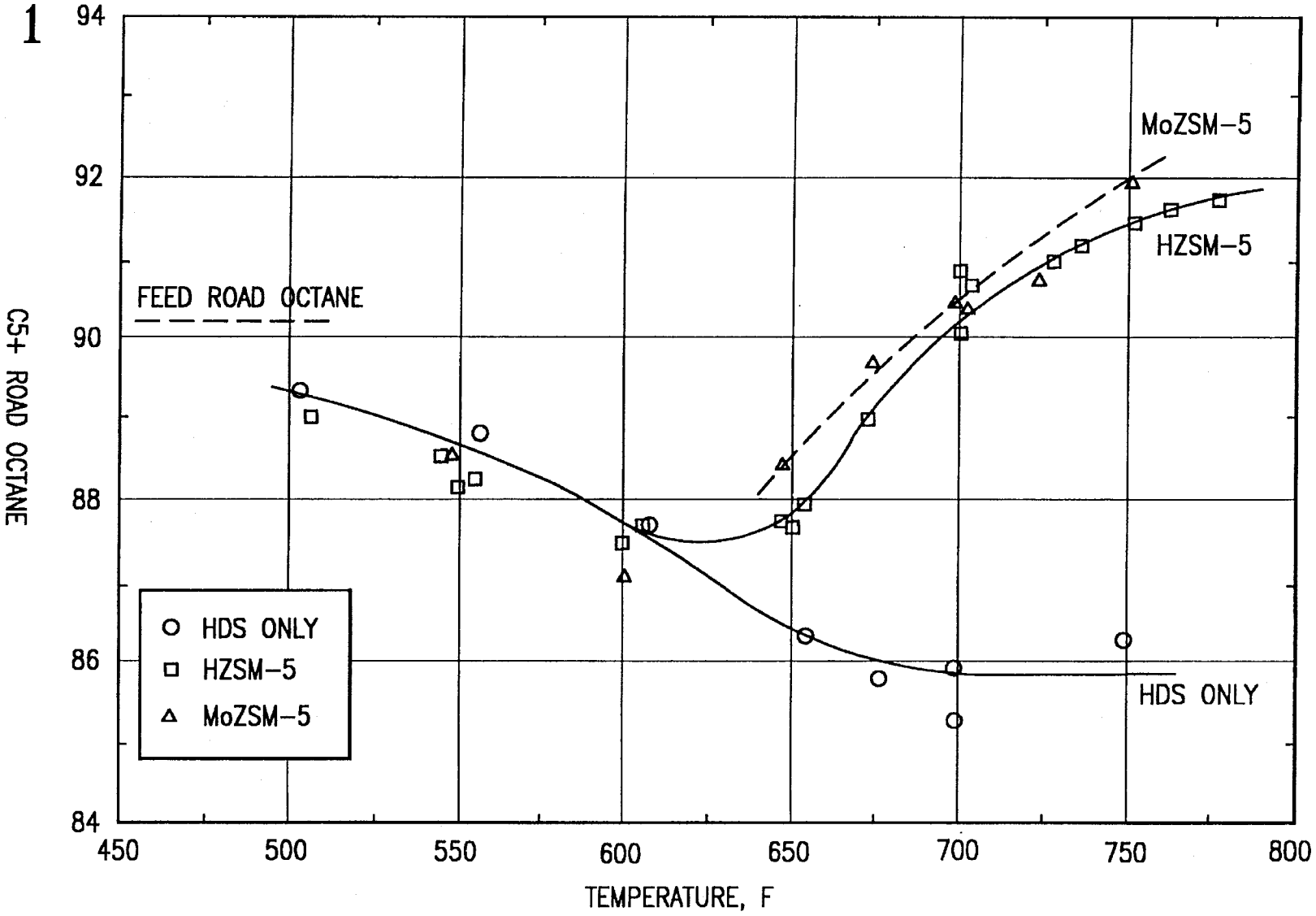
FIGS. 1 to 4 of the accompanying drawings are graphs showing the results of comparative experiments described in the Examples.

The feed to the process comprises a sulfur-containing petroleum fraction which boils in the gasoline boiling range, which can be regarded as extending from $C_6$ to about 500° F. although lower end points below the 500° F. end point are more typical. Feeds of this type include light naphthas typically having a boiling range of about $C_6$ to 330° F., full range naphthas typically having a boiling range of about $C_5$ to 420° F., heavier naphtha fractions boiling in the range of about 260° F. to 412° F., or heavy gasoline fractions boiling at, or at least within, the range of about 330° to 500° F., preferably about 330° to 412° F. While the most preferred feed appears at this time to be a heavy gasoline produced by catalytic cracking; or a light or full range gasoline boiling range fraction, the best results are obtained when, as described below, the process is operated with a gasoline boiling range fraction which has a 95 percent point (determined according to ASTM D 86) of at least about 325° F.(163° C.) and preferably at least about 350° F.(177° C.), for example, 95 percent points ($T_{95}$) of at least 380° F. (about 193° C.) or at least about 400° F. (about 220° C.). The process may be applied to thermally cracked naphthas such as pyrolysis gasoline, coker naphtha and visbreaker naphtha as well as catalytically cracked naphthas such as TCC or FCC naphtha since both types are usually characterized by the presence of olefinic unsaturation and the presence of sulfur. From the point of view of volume, however, the main application of the process is likely to be with catalytically cracked naphthas, especially FCC naphthas and for this reason, the process will be described with particular reference to the use of catalytically cracked naphthas.

The process may be operated with the entire gasoline fraction obtained from the catalytic cracking step or, alternatively, with part of it. Because the sulfur tends to be concentrated in the higher boiling fractions, it is preferable, particularly when unit capacity is limited, to separate the higher boiling fractions and process them through the steps of the present process without processing the lower boiling cut. The cut point between the treated and untreated fractions may vary according to the sulfur compounds present but usually, a cut point in the range of from about 100° F. (38° C.) to about 300° F. (150° C.), more usually in the range of about 200° F.(93° C.) to about 300° F.(150° C.) will be suitable. The exact cut point selected will depend on the sulfur specification for the gasoline product as well as on the type of sulfur compounds present: lower cut points will typically be necessary for lower product sulfur specifications. Sulfur which is present in components boiling below about 150° F.(65° C.) is mostly in the form of mercaptans which may be removed by extractive type processes such as Merox but hydrotreating is appropriate for the removal of thiophene and other cyclic sulfur compounds present in higher boiling components e.g. component fractions boiling above about 180° F.(82° C.). Treatment of the lower boiling fraction in an extractive type process coupled with hydrotreating of the higher boiling component may therefore represent a preferred economic process option. Such a variant of the process is described in Ser. No. 08/042,189, filed 30 Mar. 1993 now U.S. Pat. No. 5,360,532 and 07/001,681, filed 7 Jan. 1993 now U.S. Pat. No. 5,318,690. Higher cut points will be preferred in order to minimize the amount of feed which is passed to the hydrotreater and the final selection of cut point together with other process options such as the extractive type desulfurization will therefore be made in accordance with the product specifications, feed constraints and other factors.

The sulfur content of these catalytically cracked fractions will depend on the sulfur content of the feed to the cracker as well as on the boiling range of the selected fraction used as the feed in the process. Lighter fractions, for example, will tend to have lower sulfur contents than the higher boiling fractions. As a practical matter, the sulfur content will exceed 50 ppmw and usually will be in excess of 100 ppmw and in most cases in excess of about 500 ppmw. For the fractions which have 95 percent points over about 380° F.(193° C.), the sulfur content may exceed about 1,000 ppmw and may be as high as 4,000 or 5,000 ppmw or even higher, as shown below. The nitrogen content is not as characteristic of the feed as the sulfur content and is preferably not greater than about 20 ppmw although higher nitrogen levels typically up to about 50 ppmw may be found in certain higher boiling feeds with 95 percent points in excess of about 380° F.(193° C.). The nitrogen level will, however, usually not be greater than 250 or 300 ppmw. As a result of the cracking which has preceded the steps of the present process, the feed to the hydrodesulfurization step will be olefinic, with an olefin content of at least 5 and more typically in the range of 10 to 20, e.g. 15–20, weight percent, although higher olefin levels, for example 40 percent or even higher may be encountered in specific chargestocks such as gasoline obtained from resid catalytic cracking (RCC) processes.

Process Configuration

The selected sulfur-containing, gasoline boiling range feed is treated in two steps by first hydrotreating the feed by effective contact of the feed with a hydrotreating catalyst, which is suitably a conventional hydrotreating catalyst, such as a combination of a Group VI and a Group VIII metal on a suitable refractory support such as alumina, under hydrotreating conditions. Under these conditions, at least some of the sulfur is separated from the feed molecules and converted to hydrogen sulfide, to produce a hydrotreated intermediate product comprising a normally liquid fraction boiling in substantially the same boiling range as the feed (gasoline boiling range), but which has a lower sulfur content and a lower octane number than the feed.

The hydrotreated intermediate product which also boils in the gasoline boiling range (and usually has a boiling range which is not substantially higher than the boiling range of the feed), is then treated by contact with the ZSM-5 catalyst under conditions which produce a second product comprising a fraction which boils in the gasoline boiling range which has a higher octane number than the portion of the hydrotreated intermediate product fed to this second step. The product from this second step usually has a boiling range which is not substantially higher than the boiling range of the feed to the hydrotreater, but it is of lower sulfur content while having a comparable octane rating as the result of the second stage treatment.

Hydrotreating

The temperature of the hydrotreating step is suitably from about 400° to 850° F. (about 220° to 454° C.), preferably about 500° to 800° F. (about 260° to 427° C.) with the exact selection dependent on the desulfurization desired for a given feed and catalyst. Because the hydrogenation reactions which take place in this stage are exothermic, a rise in temperature takes place along the reactor; this is actually favorable to the overall process when it is operated in the cascade mode because the second step is one which implicates cracking, an endothermic reaction. In this case, therefore, the conditions in the first step should be adjusted not only to obtain the desired degree of desulfurization but also to produce the required inlet temperature for the second step of the process so as to promote the desired shape-selective cracking reactions in this step. A temperature rise of about 20° to 200° F. (about 11° to 111° C.) is typical under most hydrotreating conditions and with reactor inlet temperatures in the preferred 500° to 800° F. (260° to 427° C.) range, will normally provide a requisite initial temperature for cascading to the second step of the reaction. When operated in the two-stage configuration with interstage separation and heating, control of the first stage exotherm is obviously not as critical; two-stage operation may be preferred since it offers the capability of decoupling and optimizing the temperature requirements of the individual stages.

Since the feeds are readily desulfurized, low to moderate pressures may be used, typically from about 50 to 1500 psig (about 445 to 10443 kPa), preferably about 300 to 1000 psig (about 2170 to 7,000 kPa). Pressures are total system pressure, reactor inlet. Pressure will normally be chosen to maintain the desired aging rate for the catalyst in use. The space velocity (hydrodesulfurization step) is typically about 0.5 to 10 LHSV ($hr^{-1}$), preferably about 1 to 6 LHSV ($hr^{-1}$). The hydrogen to hydrocarbon ratio in the feed is typically about 500 to 5000 SCF/Bbl (about 90 to 900 $n.1.1^{-1}$), usually about 1000 to 2500 SCF/B (about 180 to 445 $n.1.1^{-1}$.). The extent of the desulfurization will depend on the feed sulfur content and, of course, on the product sulfur specification with the reaction parameters selected accordingly. It is not necessary to go to very low nitrogen levels but low nitrogen levels may improve the activity of the catalyst in the second step of the process. Normally, the denitrogenation which accompanies the desulfurization will result in an acceptable organic nitrogen content in the feed to the second step of the process; if it is necessary, however, to increase the denitrogenation in order to obtain a desired level of activity in the second step, the operating conditions in the first step may be adjusted accordingly.

The catalyst used in the hydrodesulfurization step is suitably a conventional desulfurization catalyst made up of a Group VI and/or a Group VIII metal on a suitable substrate. The Group VI metal is usually molybdenum or tungsten and the Group VIII metal usually nickel or cobalt. Combinations such as Ni—Mo or Co—Mo are typical. Other metals which possess hydrogenation functionality are also useful in this service. The support for the catalyst is conventionally a porous solid, usually alumina, or silica-alumina but other porous solids such as magnesia, titania or silica, either alone or mixed with alumina or silica-alumina may also be used, as convenient.

The particle size and the nature of the hydrotreating catalyst will usually be determined by the type of hydrotreating process which is being carried out, although in most cases this will be as a down-flow, fixed bed process.

A change in the volume of gasoline boiling range material typically takes place in the first step. Although some decrease in volume occurs as the result of the conversion to lower boiling products ($C_5$–), the conversion to $C_5$– products is typically not more than 5 vol percent and usually below 3 vol percent and is normally compensated for by the increase which takes place as a result of aromatics saturation. An increase in volume is typical for the second step of the process where, as the result of cracking the back end of the hydrotreated feed, cracking products within the gasoline boiling range are produced. An overall increase in volume of the gasoline boiling range ($C_5$+) materials may occur.

Octane Restoration—Second Step Processing

After the hydrotreating step, the hydrotreated intermediate product is passed to the second step of the process in which cracking takes place in the presence of the acidic catalyst containing the molybdenum in addition to the zeolite component, ZSM-5. The effluent from the hydrotreating step may be subjected to an interstage separation in order to remove the inorganic sulfur and nitrogen as hydrogen sulfide and ammonia as well as light ends but this is not necessary and, in fact, it has been found that the first stage can be cascaded directly into the second stage. This can be done very conveniently in a down-flow, fixed-bed reactor by loading the hydrotreating catalyst directly on top of the second stage catalyst.

The conditions used in the second step of the process are selected to favor a number of reactions which restore the octane rating of the original, cracked feed at least to a partial degree. The reactions which take place during the second step which converts low octane paraffins to form higher octane products, both by the selective cracking of heavy paraffins to lighter paraffins and the cracking of low octane n-paraffins, in both cases with the generation of olefins. Ring-opening reactions may also take place, leading to the production of further quantities of high octane gasoline boiling range components. The molybdenum-containg ZSM-5 catalyst may also function to improve product octane by dehydrocyclization/aromatization of paraffins to alkylbenzenes.

The conditions used in the second step are those which are appropriate to produce this controlled degree of cracking. Typically, the temperature of the second step will be about 300° to 900° F. (about 150° to 480° C.), preferably about 550° to 800° F. (about 287° to about 220° C.). As mentioned above, however, a convenient mode of operation is to cascade the hydrotreated effluent into the second reaction zone and this will imply that the outlet temperature from the first step will set the initial temperature for the second zone. The feed characteristics and the inlet temperature of the hydrotreating zone, coupled with the conditions used in the first stage will set the first stage exotherm and, therefore, the initial temperature of the second zone. Thus, the process can be operated in a completely integrated manner, as shown below.

The pressure in the second reaction zone is not critical since hydrogenation will not contribute to product octane although a lower pressure in this stage will tend to favor olefin production with a consequent favorable effect on product octane. The pressure will therefore depend mostly on operating convenience and will typically be comparable to that used in the first stage, particularly if cascade operation is used. Thus, the pressure will typically be about at leat 10 (about 170 kPaa) and usually from 50 to 1500 psig (about 445 to 10445 kPa), preferably about 300 to 1000 psig (about 2170 to 7000 kPa) with comparable space velocities, typically from about 0.5 to 10 LHSV ($hr^{-1}$), normally about 1 to 6 LHSV ($hr^{-1}$). The present catalyst combination of molybdenum on ZSM-5 has been found to be effective at low pressures below about 250 psig (about 1825 kPaa) and even below 200 psig (about 1480 kPaa). Hydrogen to hydrocarbon ratios typically of about 0 to 5000 SCF/Bbl (0 to 890 $n.1.1^{-1}$.), preferably about 100 to 2500 SCF/Bbl (about 18 to 445 $n.1.1^{-1}$.) will be selected to minimize catalyst aging.

The use of relatively lower hydrogen pressures thermodynamically favors the increase in volume which occurs in the second step and for this reason, overall lower pressures are preferred if this can be accommodated by the constraints on the aging of the two catalysts. In the cascade mode, the pressure in the second step may be constrained by the requirements of the first but in the two-stage mode the possibility of recompression permits the pressure requirements to be individually selected, affording the potential for optimizing conditions in each stage.

Consistent with the objective of restoring lost octane while retaining overall product volume, the conversion to products boiling below the gasoline boiling range ($C_5$–) during the second stage is held to a minimum. However, because the cracking of the heavier portions of the feed may lead to the production of products still within the gasoline range, the conversion to $C_5$– products is at a low level, in fact, a net increase in the volume of $C_5$+ material may occur during this stage of the process, particularly if the feed includes significant amount of the higher boiling fractions. It is for this reason that the use of the higher boiling naphthas is favored, especially the fractions with 95 percent points above about 350° F. (about 177° C.) and even more preferably above about 380° F. (about 193° C.) or higher, for instance, above about 400° F. (about 205° C.). Normally, however, the 95 percent point ($T_{95}$) will not exceed about 520° F. (about 270° C.) and usually will be not more than about 500° F. (about 260° C.).

The acidic component of the catalyst used in the second step is an intermediate pore size zeolite. Zeolites of this type are characterized by a crystalline structure having rings of ten-membered rings of oxygen atoms through which molecules obtain access to the intracrystalline pore volume. These zeolites have a Constraint Index from 2 to 12, as defined in U.S. Pat. No. 4,016,218, to which refeence is made for a description of the method of determining Constraint Index and examples of the Constraint Indices for a number of zeolites. Zeolites of this class are well-known; typical members of this class are the zeolites having the structures of ZSM-5, ZSM-11, ZSM-22, ZSM-23, ZSM-35, ZSM-48 and MCM-22. ZSM-5 is the preferred zeolite for use in the present process. The aluminosilicate forms of these zeolites provide the requisite degree of acidic functionality and for this reason are the preferred compositional forms of the zeolites. Other isostructural forms of the intermediate pore size zeolites containing other metals instead of aluminum such as gallium, boron or iron may also be used.

The zeolite catalyst possesses sufficient acidic functionality to bring about the desired reactions to restore the octane lost in the hydrotreating step. The catalyst should have sufficient acid activity to have cracking activity with respect to the second stage feed (the intermediate fraction), that is sufficient to convert the appropriate portion of this material as feed, suitably with an alpha value of at least about 20, usually in the range of 20 to 800 and preferably at least about 50 to 200 (values measured prior to addition of the metal component). The alpha value is one measure of the acid activity of a catalyst; it is a measure of the ability of the catalyst to crack normal hexane under prescribed conditions. This test has been widely published and is conventionally used in the petroleum cracking art, and compares the cracking activity of a catalyst under study with the cracking activity, under the same operating and feed conditions, of an amorphous silica-alumina catalyst, which has been arbitrarily designated to have an alpha activity of 1. The alpha value is an approximate indication of the catalytic cracking activity of the catalyst compared to a standard catalyst. The alpha test gives the relative rate constant (rate of normal hexane conversion per volume of catalyst per unit time) of the test catalyst relative to the standard catalyst which is taken as an alpha of 1 (Rate Constant=0.016 $sec^{-1}$). The alpha test is described in U.S. Pat. No. 3,354,078 and in *J. Catalysis,* 4, 527 (1965); 6, 278 (1966); and 61,395 (1980), to which reference is made for a description of the test. The experimental conditions of the test used to determine the alpha values referred to in this specification include a constant temperature of 538° C. and a variable flow rate as described in detail in *J. Catalysis,* 61,395 (1980).

The zeolite component of the catalyst will usually be composited with a binder or substrate because the particle sizes of the pure zeolite are too small and lead to an excessive pressure drop in a catalyst bed. This binder or substrate, which is preferably used in this service, is suitably any refractory binder material. Examples of these materials are well known and typically include silica, silica-alumina, silica-zirconia, silica-titania, alumina.

The catalyst also contains molybdenum as a component which improves catalyst activity, stability as well as for improving product quality as described above. Typically, the molybdenum will be in the oxide or the sulfide form; it may readily be converted from the oxide form to the sulfide by conventional pre-sulfiding techniques. A molybdenum content of about 0.5 to about 5 weight percent, conventionally 1 or 2 to 5 weight percent, (as metal) is suitable although higher metal loadings typically up to about 10 or 15 weight percent may be used.

The molybdenum component may be incorporated into the catalyst by conventional procedures such as impregnation into an extrudate or by mulling with the zeolite and the binder. When the molybdenum is added in the form of an anionic complex such as molybdate, impregnation or addition to the muller will be appropriate methods.

The particle size and the nature of the catalyst will usually be determined by the type of conversion process which is being carried out with operation in a down-flow, fixed bed process being typical and preferred.

The conditions of operation and the catalysts should be selected, together with appropriate feed characteristics to result in a product slate in which the gasoline product octane is not substantially lower than the octane of the feed gasoline boiling range material; that is, not lower by more than about 1 to 10 octane numbers and usually, not more than 1 to 3 octane numbers, depending on the nature of the feed. It is preferred also that the volume of the product should not be substantially less than that of the feed although yields as low as 80 precent may be achieved with certain feeds under particular conditions. In some cases, the volumetric yield and/or octane of the gasoline boiling range product may well be higher than those of the feed, as noted above and in favorable cases, the octane barrels (that is the octane number of the product times the volume of product) of the product will be higher than the octane barrels of the feed.

The operating conditions in the first and second steps may be the same or different but the exotherm from the hydrotreatment step will normally result in a higher initial temperature for the second step. Where there are distinct first and second conversion zones, whether in cascade operation or otherwise, it is often desirable to operate the two zones under different conditions. Thus the second zone may be operated at higher temperature and lower pressure than the first zone in order to maximize the octane increase obtained in this zone.

The conditions in the second stage of the process are normally dictated by process economics, the trade-off between octane and volumetric yield. Although the entire octane loss incurred in the first stage may not be fully recovered in all cases, the second stage should be operated under a combination of conditions such that at least about half (½) of the octane lost in the first stage operation will be recovered, preferably such that all of the lost octane will be recovered, most preferably that the second stage will be operated such that there is a net gain of at least about 1% in octane over that of the feed, which is about equivalent to a gain of about at least about 5% based on the octane of the hydrotreated intermediate. The process should normally be operated under a combination of conditions such that the desulfurization should be at least about 50%, preferably at least about 75%, as compared to the sulfur content of the feed.

EXAMPLES

Examples showing the use of ZSM-5 without a metal component are given in prior applications Ser. Nos. 07/850,106 and 07/745,311, to which reference is made for the details of these examples.

Examples 1 and 2 below illustrate the preparation of the ZSM-5 catalysts. Performance comparisons of these catalysts with different feeds and with a molybdenum-containing zeolite beta catalyst are given in subsequent Examples. In these examples, parts and percentages are by weight unless they are expressly stated to be on some other basis. Temperatures are in °F. and pressures in psig, unless expressly stated to be on some other basis.

Example 1

Preparation of a Mo/ZSM-5 Catalyst A physical mixture of 80 parts ZSM-5 and 20 parts pseudoboehmite alumina powder (Condea Pural™ alumina) was mulled to form a uniform mixture and formed into 1/16"to cylindrical shape extrudates using a standard augur extruder. All components were blended based on parts by weight on a 100% solids basis. The extrudates were dried on a belt drier at 127° C., and were then nitrogen calcined at 480° C. for 3 hours followed by a 6 hour air calcination at 538° C. The catalyst was then steamed at 100% stream at 480° C. for approximately 4 hours. The steamed extrudates were impregnated with 4 wt % Mo and 2 wt % P using an incipient wetness method with a solution of ammonium heptamolybdate and phosphoric acid. The impregnated extrudates were then dried at 120° C. overnight and calcined at 500° C. for 3 hours. The properties of the final catalyst are listed in Table 1 below together with the properties of the hydrotreating catalysts (CoMo, NiMo) used in the Examples.

Example 2

Preparation of HZSM-5 Catalyst

A physical mixture of 65 parts ZSM-5 and 35 parts pseudoboehmite alumina powder (LaRoche Versal™ alumina) was mulled to form a uniform mixture. All components were blended based on parts by weight on a 100% solids basis. Sufficient amount of deionized water was added to form an extrudable paste. The mixture was auger extruded to 1/16 cylindrical shape extrudates and dried on a belt drier at 127° C. The extrudates were then nitrogen calcined at 480° C. for 3 hours followed by a 6 hour air calcination at 538° C. Then catalyst was then steamed in 100% steam at 480° C. for approximately 4 hours. The properties of the final catalyst are listed in Table 1 below.

TABLE 1

| Properties of Catalysts | | | | |
|---|---|---|---|---|
| | CoMo HDS | NiMo HDS | Mo/ZSM-5 | HZSM5 |
| Zeolite | — | — | ZSM-5 | ZSM-5 |
| Zeolite, wt % | — | — | 80 | 65 |
| Alpha | — | — | 132* | 101 |
| Surface area, $m^2/g$ | 260 | 160 | 289 | 337 |
| n-Hex. srptn, cc/g | — | — | 10.4 | 10.4 |
| cy-Hex. srptn, cc/g | — | — | — | 9.3 |
| NiO, wt % | N/A | 4 | N/A | N/A |
| Co, wt % | 3.4 | N/A | N/A | N/A |
| Mo, wt % | 10.2 | 16 | 3.6 | N/A |
| P, wt % | — | — | 1.7 | N/A |

*Before Mo impregnation
N/A Not applicable

Example 3

Performance comparison with a heavy FCC naphtha

This example illustrates performance advantages of a Mo/ZMS-5 catalyst (Example 1) over a H-ZSM-5 catalyst (Example 2) for producing low sulfur gasoline.

A dehexanized FCC gasoline derived from a fluid catalytic cracking process was treated to give a substantially desulfurized product with a minimum octane loss. The feedstock properties, together with those used in other experiments described below, are shown in Table 2 below.

TABLE 2

| Properties of Naphtha Feeds | | | |
|---|---|---|---|
| | Heavy Naphtha(I) | De-Hex Gaso. | Heavy Naphtha(II) |
| Nominal Boiling Range, °F. | 350–490 | 180–400 | 320–490 |
| Specific Gravity, g/cc | 0.916 | 0.805 | 0.896 |
| Total Sulfur, wt % | 2.0 | 0.23 | 1.2 |
| Nitrogen, ppm | 180 | 86 | 150 |
| Bromine Number | 10.4 | 54.3 | 22.1 |
| Research Octane | 96.4 | 92.3 | 92.7 |
| Motor Octane | 84.0 | 80.3 | 80.6 |
| Distillation, °F. (D-2887) | | | |
| IBP | 136 | 135 | 274 |
| 5% | 323 | 163 | 322 |
| 10% | 360 | 191 | 340 |
| 30% | 408 | 237 | 404 |
| 50% | 442 | 287 | 442 |
| 70% | 456 | 336 | 466 |
| 90% | 491 | 404 | 494 |
| 95% | 510 | 422 | 501 |
| EP | 565 | 474 | 520 |

The experiments were carried out in a fixed-bed pilot unit employing a commercial $CoMo/Al_2O_3$ hydrodesulfurization (HDS) catalyst and the Mo/ZSM-5 catalyst in equal volumes. The pilot unit was operated in a cascade mode where desulfurized effluent from the hydrotreating stage cascaded directly to the zeolite-containing catalyst to restore octane without removal of ammonia, hydrogen sulfide, and light hydrocarbon gases at the interstage. The conditions employed for the experiments included a hydrogen inlet pressure of 600 psig, space velocity of 1.0 LHSV (based on fresh feed relative to total catalysts) and 3000 scf/bbl of once-through hydrogen circulation.

Table 3 and FIG. 1 compare the gasoline hydrofinishing performance of the (1) HDS and H-ZSM-5 catalyst combination and (2) HDS and Mo/ZSM-5 catalyst combination.

TABLE 3

| Process Performance Comparison with Heavy FCC Naphtha(I) | | | |
|---|---|---|---|
| | Heavy FCC Naphtha | CoMo HDS/ H-ZSM-5 | CoMo HDS/ Mo/ZSM-5 |
| Stage 1 Temp., °F. | — | 725 | 702 |
| Stage 2 Temp., °F. | — | 762 | 751 |
| Days on Stream | — | 20.4 | 12.8 |
| Product Analyses | | | |
| Sulfur, wt % | 2.0 | 0.027* | 0.006* |
| Nitrogen, ppmw | 180 | <1* | <1* |
| Research Octane | 96.4 | 98.4 | 98.7 |
| Motor Octane | 84.0 | 85.4 | 86.2 |
| Olefin Yield, wt % | | | |
| $C_2 = +C_3 = +C_4 =$ | — | 0.19 | 0.14 |
| $C_5 = +$ | — | 0.40 | 0.09 |
| $C_5$+ Gasoline Yields | | | |
| vol % | 100 | 97.9 | 93.7 |
| wt % | 100 | 94.5 | 90.2 |
| Process Yields, wt % | | | |
| $C_1 + C_2$ | — | 0.3 | 1.3 |
| $C_3$ | — | 1.8 | 3.3 |
| $C_4$ | — | 2.6 | 4.5 |
| $C_5$–390° F. | 17.7 | 35.3 | 37.9 |
| 390–420° F. | 21.1 | 18.8 | 16.8 |
| 420° F+ | 61.2 | 40.4 | 35.5 |
| Conversion, % | | | |
| 390 ° F.+ | — | 28 | 36 |
| 420 ° F.+ | — | 34 | 42 |
| Hydrogen Consumption (scf/bbl) | — | 730 | 870 |

*Measured with a $H_2S$ stripped product
Conditions: 600 psig, 1.0 Overall LHSV

The data contained in Table 3 and FIG. 1 demonstrate the improvement in activity shown by the catalyst of the present invention. For example, in the temperature range from 650° F. to 750° F., the Mo/ZSM-5 catalyst produces a gasoline with about 0.5 number higher road octane than the H-ZSM-5 catalyst. This octane advantage translates to approximately 10°–15° F. higher catalyst activity of Mo/ZSM-5 over H-ZSM-5 (FIG. 1). The Mo/ZSM-5 catalyst achieves better back-end conversion than H-ZSM-5 (Table 3). The Mo/ZSM-5 catalyst also exhibits better desulfurization ability: the product sulfur level is substantially lower (270 ppm vs. 60 ppm, Table 3).

Example 4

Performance comparison for $C_7$+ FCC naphtha

This example illustrates the performance advantages of Mo/ZSM-5 catalyst (Example 1) over a HZSM-5 catalyst (Example 2) for producing low sulfur gasoline. This example uses a $C_7$+ naphtha fraction derived from a fluid catalytic cracking process (dehexanized FCC gasoline). The experiments were conducted at nearly identical conditions to Example 3.

Figure 2:
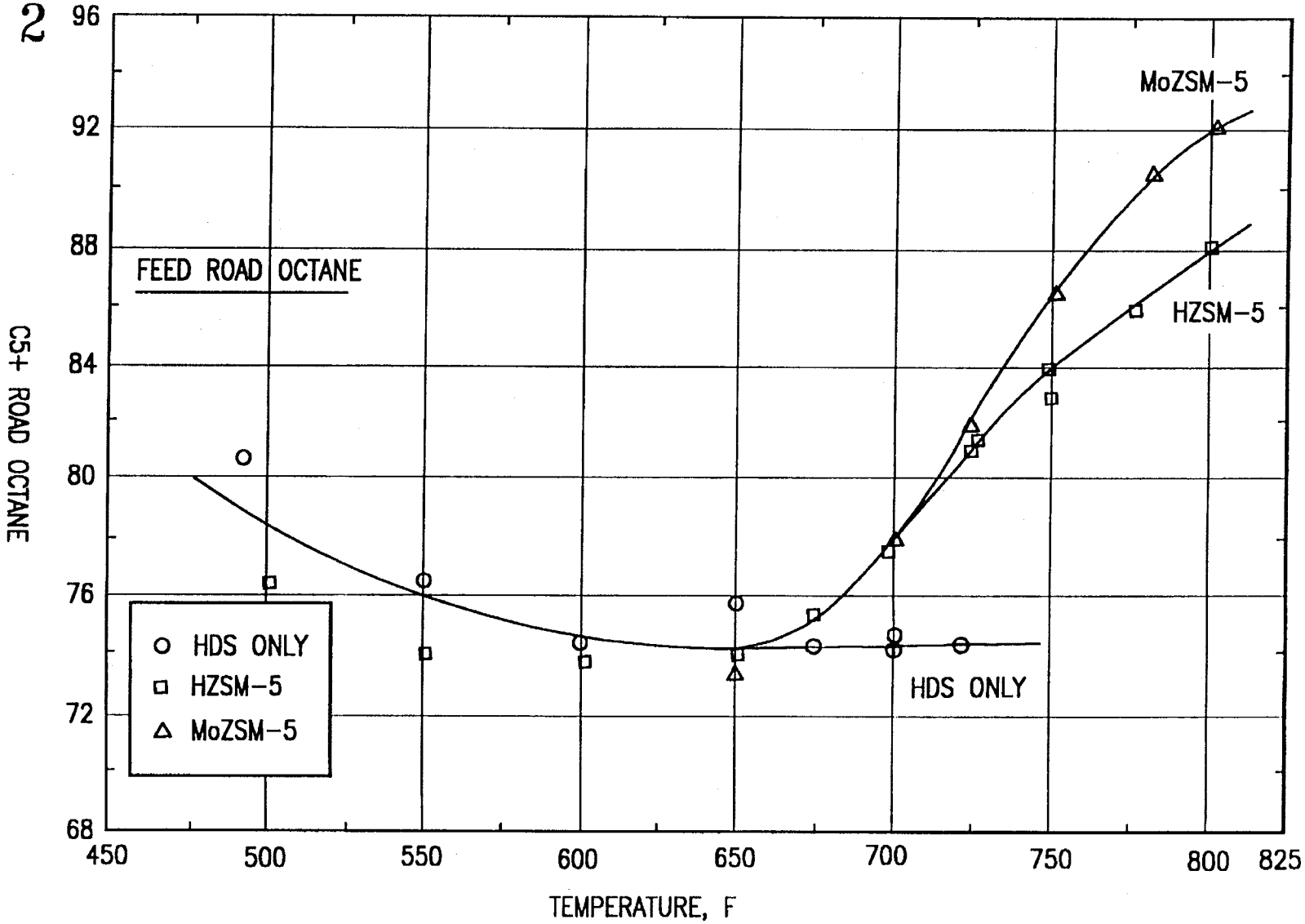

The results are shown in Table 4 below and FIG. 2; they demonstrate the improvement in activity of Mo/ZSM-5 catalyst over HZSM-5.

TABLE 4

Process Performance Comparison with $C_7$+ FCC Gasoline

| | $C_7$+ FCC Gasoline Feed | CoMo HDS/ H-ZSM-5 | CoMo HDS/ Mo/ZSM-5 |
|---|---|---|---|
| Stage 1 Temp., °F. | — | 699 | 698 |
| Stage 2 Temp., °F. | — | 749 | 752 |
| Days on Stream | — | 19.7 | 6.1 |
| Product Analyses | | | |
| Sulfur, wt % | 0.23 | 0.022* | 0.004* |
| Nitrogen, ppmw | 86 | <1* | <1* |
| Research Octane | 92.3 | 88.8 | 91.7 |
| Motor Octane | 80.3 | 80.3 | 82.7 |
| Olefin Yield, wt % | | | |
| $C_2 = +C_3 = +C_4 =$ | — | 0.93 | 0.50 |
| $C_5 = +$ | — | 0.52 | 0.12 |
| $C_5$+ Gasoline Yields | | | |
| vol % | 100 | 92.6 | 92.7 |
| wt % | 100 | 92.8 | 92.7 |
| Process Yields, wt % | | | |
| $C_1 + C_2$ | — | 0.3 | 0.3 |
| $C_3$ | — | 2.6 | 2.3 |
| $C_4$ | — | 4.7 | 4.7 |
| $C_5$–330° F. | 65.9 | 63.3 | 66.3 |
| 330–390° F. | 19.1 | 17.3 | 15.8 |
| 390° F.+ | 15.0 | 12.1 | 10.5 |
| Conversion, 330° F.+, % | — | 13 | 23 |
| Hydrogen Consump.(scf/bbl) | — | 320 | ~350 |

*Measured with a $H_2S$ stripped product
Conditions: 600 psig, 1.0 Overall LHSV

At 750° F., the H-ZSM-5 catalyst cannot recover the feed octane. The Mo/ZSM-5 catalyst exceeds the feed octane at 750° F. The CoMo HDS and Mo/ZSM-5 catalyst combination also exhibits better desulfurization ability, the product sulfur level being substantially lower (220 ppm vs. 40 ppm, Table 4). The Mo/ZSM-5 catalyst achieves much greater 330° F.+ back-end conversion than H-ZSM-5 with only a slight increase in $H_2$ consumption (Table 4).

Example 5

Performance comparison at low pressure

This example illustrates improved stability of Mo/ZSM-5 at low pressure where catalyst aging phenomena are accelerated.

The performance of Mo/ZSM-5 catalyst (Example 1) in conjunction with NiMo hydrotreating catalyst is compared with that of H-ZSM-5 (Example 2) in conjunction with CoMo hydrotreating catalyst. This example used another heavy naphtha feed with a high bromine number of 25. The operating conditions were temperature in the range of 650°–800° F. (345°–427° F.), 175 psia (1310 kPaa) $H_2$, 1LHSV, 2000 scfb (356 n.1.$1^{-1}$).

TABLE 5

Process Performance Comparison with Heavy FCC Naphtha(II)

| | Heavy FCC Naphtha Feed | CoMo HDS/ H-ZSM-5[1] | NiMo HDS/Mo/ ZSM-5[2] |
|---|---|---|---|
| Stage 1 Temp., °F. | — | 749 | 651 |
| Stage 2 Temp., °F. | — | 776 | 674 |
| Days on stream, Rx1 | — | 87 | 7 |
| Days on stream, Rx2 | — | 32 | 7 |
| Product Analyses | | | |
| Sulfur, wt % | 1.2 | | 0.004* |
| Nitrogen, ppmw | 150 | 6* | 7* |
| Research Octane | 92.7 | 93.5 | 95.5 |
| Motor Octane | 80.6 | 81.4 | 83.2 |
| $C_5$+ Gasoline Yields | | | |
| vol % | 100 | 97.0 | 96.9 |
| wt % | 100 | 95.5 | 95.7 |
| Process Yields, wt % | | | |
| $C_1 + C_2$ | — | 0.3 | 0.2 |
| $C_3$ | — | 1.5 | 1.5 |
| $C_4$ | — | 2.0 | 3.0 |
| $C_5$–330°F. | 6.9 | 20.5 | 17.3 |
| 330–390° F. | 15.9 | 20.1 | 16.4 |
| 390° F.+ | 77.2 | 54.8 | 60.9 |
| $C_2 = +C_3 = +C_4 =$ | — | 2.2 | 0.9 |
| $C_5$ Olefins wt % | — | 1.0 | 0.5 |
| 330° F.+ Conversion, % | — | 19.6 | 17.1 |
| Hydrogen Consump., scf/bbl | — | 300 | 420 |

*Measured with a $H_2S$ stripped product
[1]Conditions 230 psig, 0.95 Overall LHSV (1.9 over each catalyst bed), 2200 scfb hydrogen circulation
[2]Conditions 245 psig, 0.78 Overall LHSV (2.5 over the first catalyst bed, and 1.1 over the second bed), 2000 scfb hydrogen circulation.

Figure 3:
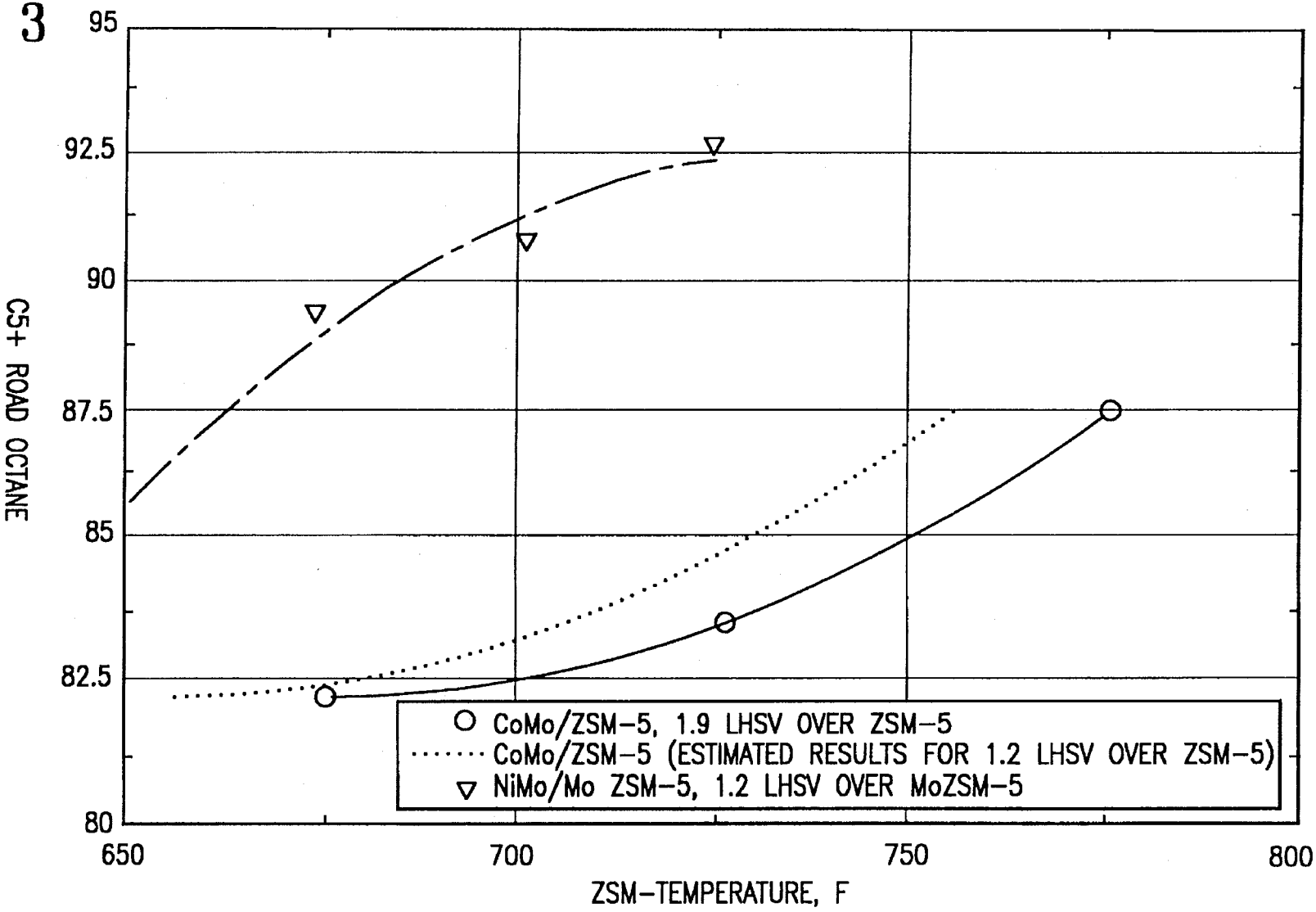

The Mo/ZSM-5 catalyst exhibits good gasoline upgrading capability at low pressure in conjunction with a NiMo hydrotreating catalyst. As shown in FIG. 3, NiMo HDS/Mo-ZSM-5 catalyst combination shows significantly higher activity than CoMo HDS/H-ZSM-5. The H-ZSM-5 catalyst was on stream for longer than the Mo-ZSM-5. Even allowing for the difference in time on stream, the NiMo/Mo-ZSM-5 system is 40°–60° F. more active. This activity advantage would increase the operating window for low pressure applications. An octane recovery at the feed level was observed at 660° F. Hydrogen consumption is higher with the new system, possibly because of the increased hydrogenation capabilities of NiMo vs CoMo HDS catalysts (Table 5).

At a given octane, the conversion with the Mo/ZSM-5 system is lower than with ZSM-5 due to the different reactor temperatures (Table 5). At constant reactor temperature, the conversion is higher, consistent with Examples 3 and 4. The $C_5$ olefin make is also lower with the NiMo/Mo-ZSM-5 system.

Figure 4:
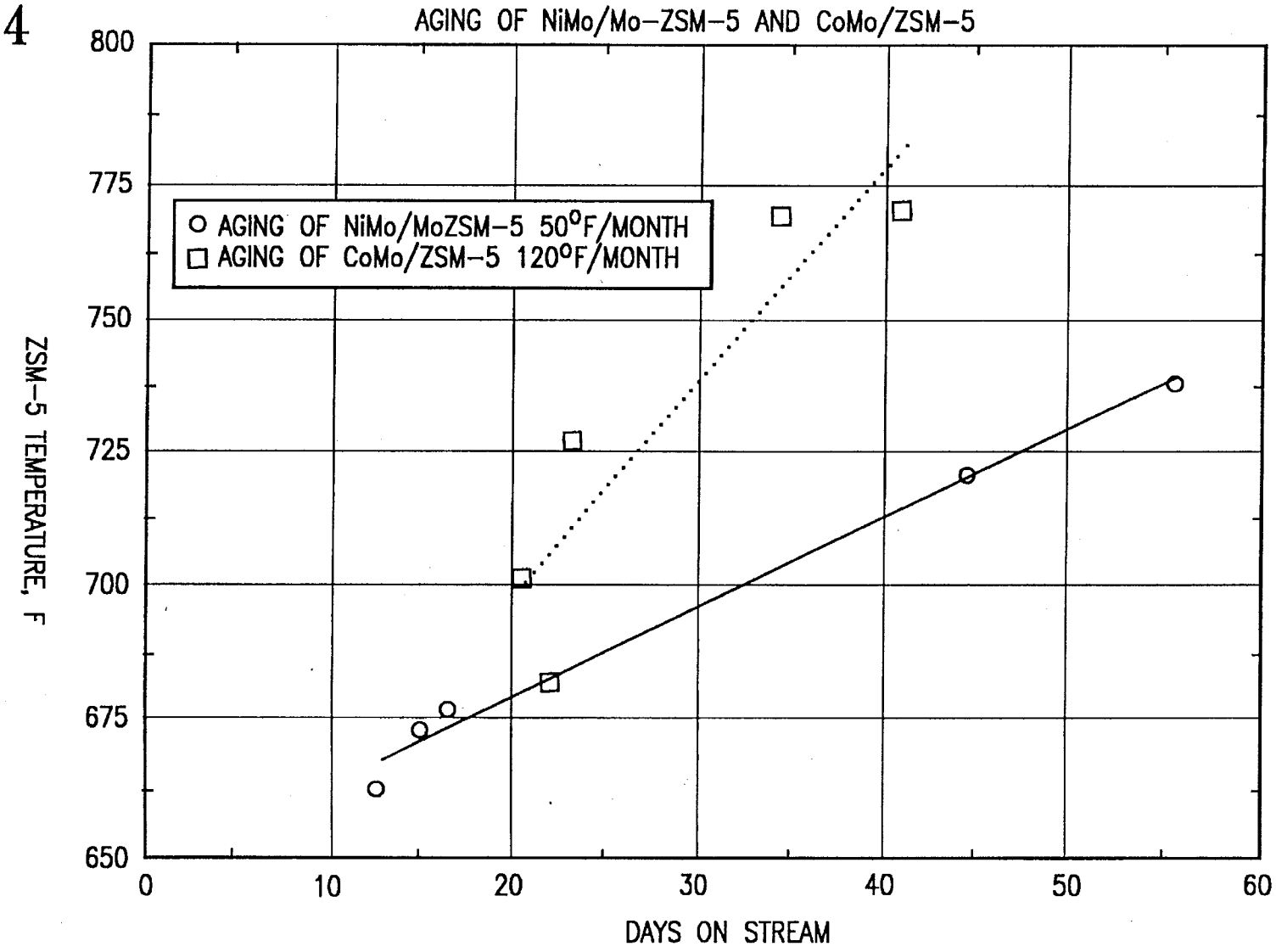

The data contained in FIG. 4 show that the NiMo HDS/Mo-ZMS-5 catalyst system is substantially more stable. After one month on stream, this catalyst system has aged about 50° F. while the CoMo/H-ZSM-5 system aged more than 100° F. (data normalized to feed octane at 17° F./octane).

Example 6

Desulfurization performance comparison for a $C_7$+ FCC naphtha (dehexanized gasoline). This example illustrates the desulfurization advantage of the Mo/ZSM-5 catalyst (Example 1) over HDT alone or in combination with ZSM-5 catalyst (Example 2) for producing low sulfur gasoline.

A sulfur GC method was used to speciate and quantify the sulfur compounds present in the gasolines using a Hewlett-Packard gas chromatograph, Model HP-5890 Series II equipped with universal sulfur-selective chemiluminescence detector (USCD). The sulfur GC detection system was published by B. Chawla and F. P. DiSanzo in *J. Chrom.* 1992, 589, 271–279.

The data contained in Table 6 demonstrate the improvement in desulfurization and octane recovery activities shown by the catalyst of the present invention for this FCC naphtha.

TABLE 6

Catalyst Effect on Desulfurized Gasoline For $C_7$+ FCC Naphtha

| | Product from HDS only Base case | Product from HDS/ H-ZSM-5 Cascade case | Product from HDS/Mo-ZSM-5 Cascade case |
|---|---|---|---|
| ABT Rx1(°F.) | 700 | 697 | 696 |
| ABT Rx2(°F.) | Nil | 700 | 701 |
| Research Octane | 77.3 | 81.3 | 81.3 |
| Motor Octane | 71.5 | 74.7 | 75.2 |
| Total RSH, ppm | 0 | 24 | 5 |
| Total Heavy S, ppm | 172 | 194 | 65 |
| Total HC Sulfur, ppm | 172 | 218 | 70 |

Table 6 compares the sulfur level and octane of gasoline samples from the (1) HDT alone, (2) HDT and ZSM-5 catalyst combination, and (3) HDT and Mo/ZSM-5 catalyst combination. The HDT and Mo/ZSM-5 combination clearly exhibits superior desulfurization activity. For example, at 700° F., the Mo/ZSM-5 catalyst produces gasoline with 70 ppm total sulfur while HDT alone produces 172 ppm S and HDT/ZSM-5 produces 218 ppm S gasoline. The mercaptan level of Mo/ZSM-5 is much lower than that of ZSM-5 (24 vs. 5 ppm).

Example 7

Desulfurization performance comparison for a heavy FCC naphtha

This example illustrates the desulfurization advantage of the HDS/Mo-ZSM-5 catalyst combination over HDS/H-ZSM-5 catalyst combination for producing low sulfur gasoline for the heavy FCC naphtha used in Example 3. The results are given in Table 7 below.

TABLE 7

Catalyst Effect on Desulfurized Gasoline For Heavy FCC Naphtha(I)

| | Product of HDS only Base | Product of HDS/ HZSM-5 Cascade | Product of HDS/ MoZSM-5 Cascade |
|---|---|---|---|
| ABT Rx1(°F.) | 700 | 700 | 700 |
| ABT Rx2(°F.) | Nil | 700 | 702 |
| Research Octane | 91.3 | 96.8 | 97.2 |
| Motor Octane | 79.4 | 83.7 | 84.3 |
| Total Mercaptans, ppm | 0 | 252 | 31 |
| Total Heavy S, ppm | 174 | 155 | 179 |
| Unknown S, ppm | 2 | 12 | 4 |

TABLE 7-continued

Catalyst Effect on Desulfurized Gasoline For Heavy FCC Naphtha(I)

| | Product of HDS only Base | Product of HDS/ HZSM-5 Cascade | Product of HDS/ MoZSM-5 Cascade |
|---|---|---|---|
| Total HC Sulfur, ppm | 176 | 419 | 214 |

The data in Table 7 demonstrate the improvement in desulfurization activity by the Mo/ZSM-5 catalyst. For example, at 700° F., the Mo/ZSM-5 catalyst produces gasoline with 214 ppm total sulfur while HDT alone produces 176 ppm S and HDT/ZSM-5 produces 419 ppm S gasoline. The mercaptan level of Mo/ZSM-5 is much lower than that of ZSM-5 (240 vs. 31 ppm).

The main mechanisms for the excellent desulfurization of Mo/ZSM-5 catalyst is believed to be by suppression of mercaptan formation and possibly by cracking of heavy sulfur species. The Mo in the Mo/ZSM-5 catalyst may saturate the olefins and hence hinders the recombination reactions which would tend to mercaptan formation.

Example 8

Performance comparison between zeolite beta and zeolite ZSM-5 with Coker Naphtha Feed For this comparison, a nominal 100°–360° F. coker naphtha was used as the feed. Its properties are given in Table 8 below.

TABLE 8

PROPERTIES OF COKER NAPHTHA FEED

| General Properties | |
|---|---|
| Nominal Boiling Range, °F. | 100–360 |
| Specific Gravity, g/cc | 0.742 |
| Total Sulfur, wt % | 0.7 |
| Nitrogen, ppm | 71 |
| Bromine Number | 72.0 |
| Research Octane | 68.0 |
| Motor Octane | 60.6 |
| Distillation, °F. (D2887) | |
| IBP | 70 |
| 5% | 98 |
| 10% | 138 |
| 30% | 205 |
| 50% | 254 |
| 70% | 297 |
| 90% | 341 |
| 95% | 351 |
| EP | 413 |

This coker naphtha was treated over the same CoMo hydrodesulfurization catalyst used in preceding examples in a cascade operation at 600 psig, 3000 scf/bbl $H_2$/oil ratio, 1.0 overall LHSV, using temperatures at about 700° F. in the hydrotreating stage and varying temperatures in the second (Mo/ZSM-5 stage). The same naphtha was also treated in the same way but using a Mo/zeolite beta catalyst in the second stage. The Mo/zeolite beta catalyst contained 4 weight percent Mo, based on the total catalyst weight. The operating conditions, comparable to those used for the runs with the ZSM-5 catalyst, are shown in Table 10 below, together with the results with this catalyst.

TABLE 9

Upgrading of Coker Naphtha with Mo/ZSM-5

| | Feed | CoMo HDS/ Mo/ZSM-5 | | |
|---|---|---|---|---|
| Stage 1 Temp., °F. | — | 705 | 701 | 702 |
| Stage 2 Temp., °F. | — | 693 | 753 | 778 |
| Days on Stream | — | 5.0 | 8.2 | 9.2 |
| Product Analyses | | | | |
| Sulfur, wt % | 0.7 | 0.020* | 0.006* | 0.012* |
| Nitrogen, ppmw | 71 | <1* | <1* | 7* |
| Research Octane | 68.0 | 42.8 | 68.7 | 78.4 |
| Motor Octane | 60.6 | 44.3 | 66.0 | 75.0 |
| Olefin Yield, wt % | | | | |
| $C_2 = +C_3 = +C_4 =$ | — | 0.2 | 1.4 | 1.2 |
| $C_5 =$ | — | 0.2 | 0.6 | 0.4 |
| $C_5$+ Gasoline Yields | | | | |
| vol % | 100 | 100.3 | 79.3 | 68.8 |
| wt % | 100 | 98.8 | 78.1 | 68.4 |
| Process Yields, wt % | | | | |
| $C_1 + C_2$ | — | 0.1 | 1.1 | 2.2 |
| $C_3$ | — | 0.4 | 9.0 | 13.8 |
| $C_4$ | — | 1.0 | 12.4 | 16.4 |
| $C_5$–300° F. | 71.3 | 71.4 | 61.7 | 52.0 |
| 300° F.+ | 28.7 | 27.4 | 16.4 | 16.4 |
| 300° F.+ Conversion, % | — | 11 | 47 | 47 |
| Hydrogen consump., scf/bbl | — | 400 | 600 | 800 |

*Measured with a $H_2S$ stripped product
Conditions: 600 psig, 3000 scf/bbl, 1.0 overall LHSV

TABLE 10

Upgrading of Coker Naphtha with Mo/BETA

| | Feed | CoMo HDS/ Mo/Beta | | | |
|---|---|---|---|---|---|
| Stage 1 Temp., °F. | — | 651 | 702 | 707 | 706 |
| Stage 2 Temp., °F. | — | 647 | 698 | 753 | 776 |
| Days on Stream | — | 27.4 | 28.4 | 29.4 | 31.4 |
| Product Analyses | | | | | |
| Sulfur, wt % | 0.7 | 0.005* | 0.005* | 0.019* | 0.009* |
| Nitrogen, ppmw | 71 | 1* | 1* | 2* | <1* |
| Research Octane | 68.0 | 42.0 | 43.3 | 52.8 | 51.6 |
| Motor Octane | 60.6 | 43.8 | 46.0 | 52.9 | 52.9 |
| Olefin Yield, wt % | | | | | |
| $C_2 = +C_3 = +C_4 =$ | — | 0.2 | 0.6 | 0.6 | 0.6 |
| $C_5 = +$ | 39.9 | 0.1 | 0.3 | 0.3 | 0.3 |
| $C_5$+ Gasoline Yields | | | | | |
| vol % | 100 | 97.7 | 94.4 | 92.9 | 93.4 |
| wt % | 100 | 96.6 | 93.1 | 92.7 | 92.4 |
| Process Yields, wt % | | | | | |
| $C_1 + C_2$ | — | 0.1 | 0.2 | 0.2 | 0.2 |
| $C_3$ | — | 0.6 | 1.3 | 1.3 | 1.4 |
| $C_4$ | — | 2.9 | 5.6 | 5.7 | 6.1 |
| $C_5$–300° F. | 71.3 | 71.4 | 71.3 | 69.7 | 71.9 |
| 300° F.+ | 28.7 | 25.2 | 21.8 | 23.0 | 20.5 |

TABLE 10-continued

Upgrading of Coker Naphtha with Mo/BETA

| | Feed | CoMo HDS/ Mo/Beta | | | |
|---|---|---|---|---|---|
| Conversion, % | | | | | |
| 300° F.+ | — | 19 | 30 | 26 | 34 |
| Hydrogen consump., (scf/bbl) | — | 400 | 500 | 300 | 400 |

* Measured with a $H_2S$ stripped product
Conditions: 600 psig, 3000 scf/bbl, 1.0 overall LHSV The results in Tables 9 and 10 show that the combination of the hydrodesulfurization catalyst and the Mo/ZSM-5 can produce desulfurized gasoline with a road octane number of 77 at about 68 percent yield. By contrast, the zeolite beta catalyst can only improve the road octane number to 53 although both catalysts produce low sulfur gasoline range product.

We claim:

1. A process of upgrading a cracked, olefinic sulfur-containing feed fraction boiling in the gasoline boiling range which comprises:

contacting a cracked, olefinic, sulfur-containing feed fraction having a 95 percent point of at least 325° F. with a hydrodesulfurization catalyst in a first reaction zone, operating under a combination of elevated temperature, elevated pressure and an atmosphere comprising hydrogen, to produce an intermediate product comprising a normally liquid fraction which has a reduced sulfur content and a reduced octane number as compared to the feed;

contacting at least the gasoline boiling range portion of the intermediate product in a second reaction zone in the presence of hydrogen with an acidic catalyst comprising an intermediate pore size zeolite in combination with a molybdenum component, to convert the gasoline boiling range portion of the intermediate product to a product comprising a fraction boiling in the gasoline boiling range having a higher octane number than the gasoline boiling range fraction of the intermediate product.

2. The process as claimed in claim 1 in which the feed fraction comprises a full range catalytically cracked naphtha fraction having a boiling range within the range of $C_5$ to 420° F.

3. The process as claimed in claim 1 in which the feed fraction comprises a heavy catalytically cracked naphtha fraction having a boiling range within the range of 330° to 500° F.

4. The process as claimed in claim 1 in which the feed fraction comprises a heavy catalytically cracked naphtha fraction having a boiling range within the range of 330° to 412° F.

5. The process as claimed in claim 1 in which the feed fraction comprises a naphtha fraction having a 95 percent point of at least about 380° F.

6. The process as claimed in claim 5 in which the feed fraction comprises a naphtha fraction having a 95 percent point of at least about 400° F.

7. The process as claimed in claim 1 in which the feed fraction comprises a thermally cracked naphtha fraction.

8. The process as claimed in claim 7 in which the thermally cracked naphtha fraction comprises a coker naphtha.

9. The process as claimed in claim 1 in which the zeolite catalyst is a ZSM-5 catalyst comprising zeolite ZSM-5 in the aluminosilicate form.

10. The process as claimed in claim 1 in which the intermediate pore size zeolite catalyst includes from about 1 to 15 weight percent molybdenum by weight of the catalyst.

11. The process as claimed in claim 1 in which the hydrodesulfurization is carried out at a temperature of about 400° to 800° F., a pressure of about 50 to 1500 psig, a space velocity of about 0.5 to 10 LHSV, and a hydrogen to hydrocarbon ratio of about 500 to 5000 standard cubic feet of hydrogen per barrel of feed.

12. The process as claimed in claim 1 in which the second stage upgrading is carried out at a temperature of about 300° to 900° F., a pressure of about 10 to 1500 psig, a space velocity of about 0.5 to 10 LHSV, and a hydrogen to hydrocarbon ratio of about 0 to 5000 standard cubic feet of hydrogen per barrel of feed.

13. The process as claimed in claim 12 in which the second stage upgrading is carried out at a temperature of about 350° to 900° F., a pressure of about 300 to 1000 psig, a space velocity of about 1 to 6 LHSV, and a hydrogen to hydrocarbon ratio of about 100 to 2500 standard cubic feet of hydrogen per barrel of feed.

14. The process as claimed in claim 1 which is carried out in cascade.

15. The process as claimed in claim 1 in which the product fraction boiling in the gasoline boiling range has a higher octane number and a lower total sulfur content than that of the gasoline boiling range fraction of the intermediate product.

16. The process as claimed in claim 1 in which the total sulfur content of the product fraction boiling in the gasoline boiling range is not more than 100 ppmw.

17. The process as claimed in claim 16 in which the total sulfur content of the product fraction boiling in the gasoline boiling range is not more than 50 ppmw.

18. The process as claimed in claim 1 in which the product gasoline fraction has an octane number (research) of at least 88.

19. A process of upgrading a catalytically cracked, olefinic sulfur-containing feed fraction boiling in the gasoline boiling range which comprises:

hydrodesulfurizing a cracked, olefinic, sulfur-containing gasoline feed having a sulfur content of at least 50 ppmw, an olefin content of at least 5 percent and a 95 percent point of at least 325° F. with a hydrodesulfurization catalyst in a hydrodesulfurization zone, operating under a combination of elevated temperature, elevated pressure and an atmosphere comprising hydrogen, to produce an intermediate product comprising a normally liquid fraction which has a reduced sulfur content and a reduced octane number as compared to the feed;

contacting the gasoline boiling range portion of the intermediate product in a second reaction zone in the presence of hydrogen with a catalyst comprising zeolite ZSM-5 and from 2 to 10 weight percent of a molybdenum component, to convert the intermediate product to a product comprising a fraction boiling in the gasoline boiling range having a higher octane number than the gasoline boiling range fraction of the intermediate product.

20. The process as claimed in claim 19 in which the feed fraction has a 95 percent point of at least 350° F., an olefin content of 10 to 20 weight percent, a sulfur content from 100 to 5,000 ppmw and a nitrogen content of 5 to 250 ppmw.

* * * * *